US011796203B2

(12) United States Patent
Ishii et al.

(10) Patent No.: US 11,796,203 B2
(45) Date of Patent: Oct. 24, 2023

(54) AIR-CONDITIONING APPARATUS

(71) Applicant: Mitsubishi Electric Corporation, Tokyo (JP)

(72) Inventors: Naoto Ishii, Tokyo (JP); Yuji Motomura, Tokyo (JP); Kimitaka Kadowaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 471 days.

(21) Appl. No.: 17/264,040

(22) PCT Filed: Sep. 28, 2018

(86) PCT No.: PCT/JP2018/036574
§ 371 (c)(1),
(2) Date: Jan. 28, 2021

(87) PCT Pub. No.: WO2020/066014
PCT Pub. Date: Apr. 2, 2020

(65) Prior Publication Data

US 2021/0302046 A1 Sep. 30, 2021

(51) Int. Cl.
*F24F 11/52* (2018.01)
*F24F 11/74* (2018.01)
(Continued)

(52) U.S. Cl.
CPC ..... *F24F 11/52* (2018.01); *F24F 11/61* (2018.01); *F24F 11/74* (2018.01); *F24F 11/85* (2018.01)

(58) Field of Classification Search
CPC .. F24F 11/52; F24F 11/61; F24F 11/74; F24F 11/85; F25B 2600/01; F25B 2600/13
See application file for complete search history.

(56) References Cited

U.S. PATENT DOCUMENTS

2015/0330673 A1* 11/2015 Honda ..... F25B 13/00 62/324.1
2020/0171919 A1* 6/2020 Ishizeki ..... B60H 1/00914

FOREIGN PATENT DOCUMENTS

CN 106322664 A * 1/2017 ..... F25B 49/022
JP 2003214778 A * 7/2003 ..... F28D 7/0008
(Continued)

OTHER PUBLICATIONS

JP-2003214778-A English Translation (Year: 2003).*
(Continued)

*Primary Examiner* — David J Teitelbaum
(74) *Attorney, Agent, or Firm* — POSZ LAW GROUP, PLC

(57) ABSTRACT

An air-conditioning apparatus includes: a heat medium circulation circuit including: a heat medium device, a heat medium pipe, a pump, a heat medium detection unit, and a controller that includes a count unit to count an air-conditioning operation time and count a pump operation time based on heat medium detection information of the heat medium detection unit, a storage unit storing a set air-conditioning time and a set pump time, a comparison unit to compare the air-conditioning operation time with the set air-conditioning time and compare the pump operation time with the set pump time, and a device control unit to control driving of the pump so that the pump operation time reaches or exceeds the set pump time when the air-conditioning operation time is longer than or equal to the set air-conditioning time and the pump operation time is shorter than the set pump time.

8 Claims, 10 Drawing Sheets

(51) Int. Cl.
*F24F 11/85* (2018.01)
*F24F 11/61* (2018.01)

(56) References Cited

FOREIGN PATENT DOCUMENTS

| | | | | |
|---|---|---|---|---|
| JP | 2014-020704 | A | 2/2014 | |
| WO | WO-2012043804 | A1 * | 4/2012 | ..... F25B 39/02 |

OTHER PUBLICATIONS

WO-2012043804-A1 English Translation (Year: 2012).*
CN-106322664-A English Translation (Year: 2017).*
International Search Report of the International Searching Authority dated Oct. 30, 2018 for the corresponding international application No. PCT/JP2018/036574 (and English translation).

* cited by examiner

AIR-CONDITIONING APPARATUS

CROSS REFERENCE TO RELATED APPLICATION

This application is a U.S. national stage application of PCT/JP2018/036574 filed on Sep. 28, 2018, the contents of which are incorporated herein by reference.

TECHNICAL FIELD

The present disclosure relates to an air-conditioning apparatus that exchanges heat between refrigerant circulating in a refrigerant cycle circuit and a heat medium circulating in a heat medium circulation circuit.

BACKGROUND ART

Conventionally, in a heat medium circulation circuit in which a heat medium such as water circulates, a heat medium device, such as a heat medium heat exchanger, provided on the heat medium circulation circuit is connected to a heat medium pipe of the heat medium circulation circuit by using a connection material such as a brazing material. In general, heat medium devices and heat medium pipes are made of copper, and brazing materials for connecting heat medium devices to heat medium pipes contain silver. Thus, when a heat medium device and a heat medium pipe are connected by using a brazing material, the connection portion is corroded because different kinds of metal are made contact with each other.

When the heat medium circulates in the heat medium circulation circuit, an oxide film is formed on the connection portion of the heat medium device and the heat medium pipe owing to an oxygen component in the heat medium. Because the formed oxide film covers the connection portion, contact of different kinds of metal is prevented between the heat medium device and the brazing material and also between the heat medium pipe and the brazing material, and thus progression of the corrosion is reduced.

CITATION LIST

Patent Literature

Patent Literature 1: Japanese Unexamined Patent Application Publication No. 2014-020704

SUMMARY OF INVENTION

Technical Problem

Meanwhile, when the heat medium is not circulated in the heat medium circulation circuit for a certain period of time or when the heat medium is in a stagnation state, an oxide film is not formed because the amount of oxygen supplied to the connection portion of the heat medium device and the heat medium pipe is reduced. Consequently, in such a case, an oxide film is not formed and corrosion progresses at the connection portion.

The present disclosure has been made to solve the above problem in a prior art, and an object of the present disclosure is to provide an air-conditioning apparatus capable of promoting formation of an oxide film at the connection portion of a heat medium device and a heat medium pipe, thereby preventing corrosion at the connection portion.

Solution to Problem

An air-conditioning apparatus according to one embodiment of the present disclosure includes a heat medium circulation circuit in which a heat medium device and a heat medium pipe, which are made of a metal material, are connected to each other by using a connection material containing a different metal material from the metal material and in which a heat medium is circulated, a pump provided on the heat medium circulation circuit and configured to circulate the heat medium, a heat medium detection unit configured to detect a state of the heat medium circulated in the heat medium circulation circuit, and a controller configured to control the pump according to presence or absence of a flow of the heat medium. The controller includes a count unit configured to count an air-conditioning operation time indicating an operation time of the air-conditioning apparatus and count a pump operation time indicating an operation time of the pump based on heat medium detection information indicating a detection result by the heat medium detection unit, a storage unit that stores a set air-conditioning time for the air-conditioning operation time and a set pump time for the pump operation time, a comparison unit configured to compare the air-conditioning operation time counted by the count unit with the set air-conditioning time stored in the storage unit and compare the pump operation time with the set pump time, and a device control unit configured to control driving of the pump so that the pump operation time reaches or exceeds the set pump time when the comparison results of the comparison unit indicate that the air-conditioning operation time is longer than or equal to the set air-conditioning time and the pump operation time is shorter than the set pump time.

Advantageous Effects of Invention

According to one embodiment of the present disclosure, the air-conditioning operation time is compared with the set air-conditioning time and the pump operation time is compared with the set pump time, and the pump is driven according to the results of the comparisons. Consequently, because the heat medium is forcibly circulated in the heat medium circulation circuit, formation of an oxide film is promoted at the connection portion of the heat medium device and the heat medium pipe, and thus corrosion is prevented from occurring.

DESCRIPTION OF EMBODIMENTS

Figure 1:
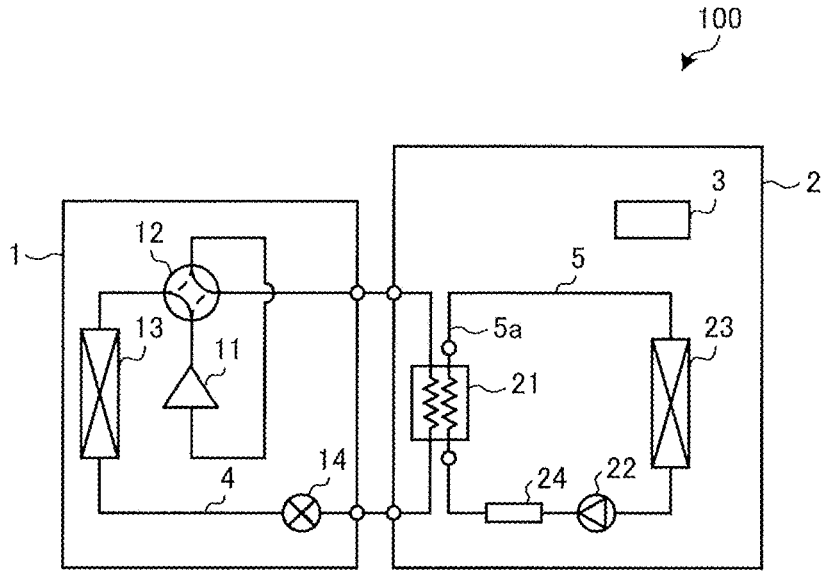
FIG. 1 is a schematic diagram illustrating an example of a configuration of an air-conditioning apparatus according to Embodiment 1.

Now, embodiments of an air-conditioning apparatus according to the present disclosure will be explained with reference to the drawings. In the drawings referred to below, components that are denoted by the same reference symbols are the same or corresponding components, and this applies to the entire embodiments described below. Moreover, in the drawings, a relationship of sizes of components may be different from that of actual ones. Further, modes of components described in the entire description are mere examples, and the components are not limited to the modes given in the description. In particular, combinations of components are not limited to the combinations described in the embodiments, and a component described in one embodiment may be applied to another embodiment.

Embodiment 1

An air-conditioning apparatus according to Embodiment 1 will be explained. This air-conditioning apparatus includes a refrigerant cycle circuit, in which refrigerant is circulated, and a heat medium circulation circuit, in which a heat medium is circulated, and is configured to perform air-conditioning in an air-conditioned space by cooling or heating the heat medium flowing in the heat medium circulation circuit by the refrigerant flowing in the refrigerant cycle circuit, when performing cooling and heating operation.

[Configuration of Air-Conditioning Apparatus 100]

FIG. 1 is a schematic diagram illustrating an example of a configuration of an air-conditioning apparatus 100 according to Embodiment 1. As shown in FIG. 1, the air-conditioning apparatus 100 includes an outdoor unit 1, an indoor unit 2, and a controller 3. In this example, the controller 3 is installed in the indoor unit 2, but the configuration is not limited thereto. The controller 3 may be installed at the outdoor unit 1 or may be provided separately from the outdoor unit 1 and the indoor unit 2.

(Outdoor Unit 1)

The outdoor unit 1 includes a compressor 11, a refrigerant flow switching device 12, an outdoor heat exchanger 13, and an expansion device 14. The compressor 11, the refrigerant flow switching device 12, the outdoor heat exchanger 13, the expansion device 14 and a refrigerant side flow path of a heat medium heat exchanger 21, which will be described later, installed in the indoor unit 2 are annularly connected by a refrigerant pipe to form a refrigerant cycle circuit 4, in which refrigerant is circulated.

As the refrigerant to be circulated in the refrigerant cycle circuit 4, a single refrigerant such as R-22 or R-134a, a near-azeotropic refrigerant mixture such as R-410A or R-404A, or a non-azeotropic refrigerant mixture such as R-4070 is used, for example. In addition, a refrigerant, or a mixture thereof, having a double bond in the chemical formula, such as $CF_3CF{=}CH_2$, which has a relatively low global warming potential, or a natural refrigerant such as $CO_2$ or propane may be used.

The compressor 11 is configured to suck the refrigerant in a low-temperature, low-pressure state, compress the sucked refrigerant, and discharge the refrigerant in a high-temperature, high-pressure state. The compressor 11 is, for example, an inverter compressor, or a similar device, that controls the capacity, which is the amount of delivery per unit time, by changing an operation frequency. The operation frequency of the compressor 11 is controlled by the controller 3, which will be described later.

The refrigerant flow switching device 12 is, for example, a four-way valve and is configured to switch between a cooling operation and a heating operation by changing the direction of refrigerant flow. In a cooling operation, the refrigerant flow switching device 12 is switched to a flow path shown by a solid line in FIG. 1 so that the discharge side of the compressor 11 is connected to the outdoor heat exchanger 13. In a heating operation, the refrigerant flow switching device 12 is switched to a flow path shown by a broken line in FIG. 1 so that the discharge side of the compressor 11 is connected to the indoor unit side. Switching of the flow paths in the refrigerant flow switching device 12 is controlled by the controller 3.

The outdoor heat exchanger 13 exchanges heat between an outdoor air supplied by a fan (not shown) and the refrigerant. In a cooling operation, the outdoor heat exchanger 13 functions as a condenser, which rejects heat of the refrigerant to the outdoor air to condense the refrigerant. In a heating operation, the outdoor heat exchanger 13 functions as an evaporator, which evaporates the refrigerant and cools the outdoor air by the resulting vaporization heat.

The expansion device 14 is, for example, an expansion valve and is configured to expand the refrigerant. The expansion device 14 is, for example, an electronic expansion valve, or other similar valve, whose opening degree can be controlled variably. The opening degree of the expansion device 14 is controlled by the controller 3.

(Indoor Unit 2)

The indoor unit 2 includes a heat medium heat exchanger 21, a pump 22, an indoor heat exchanger 23, and a flowmeter 24 as a heat medium detection unit. The heat medium heat exchanger 21, the pump 22, the indoor heat exchanger 23, and the flowmeter 24 are annularly connected by a heat medium pipe 5*a* to form a heat medium circulation circuit 5, in which the heat medium is circulated. As the heat medium, water, brine (antifreeze liquid), a mixture of water and brine, or a similar liquid is used, for example.

The heat medium heat exchanger 21 functions as a condenser or an evaporator, and is configured to exchange heat between the refrigerant flowing in the refrigerant cycle circuit 4, which is connected to a refrigerant side flow path of the heat medium heat exchanger 21, and the heat medium flowing in the heat medium circulation circuit 5, which is connected to a heat medium side flow path of the heat medium heat exchanger 21. In a cooling operation, the heat medium heat exchanger 21 functions as an evaporator, which evaporates the refrigerant and cools the heat medium by the resulting vaporization heat. In a heating operation, the heat medium heat exchanger 21 functions as a condenser, which rejects heat of the refrigerant to the heat medium to condense the refrigerant.

The pump 22 is driven by a motor (not shown) to cause the heat medium flowing in the heat medium pipe 5*a* to circulate. The pump 22 is, for example, a pump or a similar device capable of controlling the capacity, and thus can adjust the flow rate of the heat medium. Driving of the pump 22 is controlled by the controller 3.

The indoor heat exchanger 23 is configured to exchange heat between an indoor air supplied by a fan (not shown) and the heat medium. Consequently, air for cooling or air for heating, which is an air-conditioned air to be supplied to an indoor space, is generated. The flowmeter 24 is configured to detect the presence or absence of a flow of the heat medium in the heat medium circulation circuit 5 and the flow rate of the heat medium when a flow of the heat medium is present in the heat medium circulation circuit 5, and output heat medium detection information indicating the detection results.

Note that, the indoor unit 2 is not limited to the configuration explained above. The heat medium heat exchanger 21 and the pump 22 may be provided in a relay unit (branched-flow controller) and the indoor heat exchanger 23 may be provided in the indoor unit.

(Controller 3)

The controller 3 is configured to control operation of the whole air-conditioning apparatus 100 including the outdoor unit 1 and the indoor unit 2, based on various types of information received from various sensors installed at respective sections of the air-conditioning apparatus 100. In particular, in Embodiment 1, the controller 3 controls driving of the pump 22 based on an operation time of the air-conditioning apparatus 100 and an operation time of the pump 22.

Figure 2:
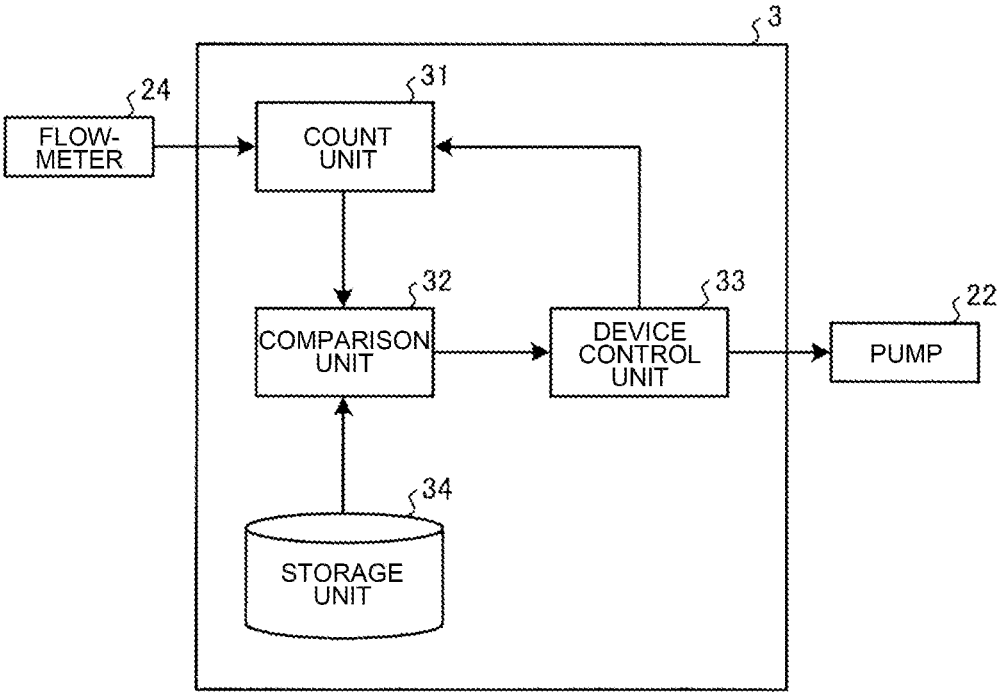
FIG. 2 is a functional block diagram illustrating an example of a configuration of a controller of FIG. 1.

FIG. 2 is a functional block diagram illustrating an example of a configuration of the controller 3 of FIG. 1. As shown in FIG. 2, the controller 3 includes a count unit 31, a comparison unit 32, a device control unit 33, and a storage unit 34. The controller 3 achieves various functions by executing software on an arithmetic device such as a microcomputer, or is made of hardware such as a circuit device, which achieves various functions.

The count unit 31 is configured to count an air-conditioning operation time, which is the operation time of the air-conditioning apparatus 100. The count unit 31 is configured to count also a pump operation time, which is the operation time of the pump 22, based on the heat medium detection information supplied from the flowmeter 24, the information indicating that the heat medium flows in the heat medium circulation circuit 5. The air-conditioning operation time and the pump operation time counted by the count unit 31 will be reset by the device control unit 33.

The comparison unit 32 is configured to compare the air-conditioning operation time counted by the count unit 31 with the set air-conditioning time stored in the storage unit 34. The comparison unit 32 is configured to compare also the pump operation time counted by the count unit 31 with the set pump time stored in the storage unit 34.

The set air-conditioning time is a threshold for the air-conditioning operation time, and is set to such a time that the presence or absence of an oxide film can be determined, for example. Details of the oxide film will be explained later. The set pump time is a threshold for the pump operation time, and is set to such a time that formation of an oxide film can be determined, for example.

The device control unit 33 is configured to control driving of the pump 22 based on the comparison results by the comparison unit 32. More specifically, the device control unit 33 causes the pump 22 to operate when the pump operation time does not reach the set pump time. The device control unit 33 also resets the air-conditioning operation time and the pump operation time counted b the count unit 31 when the pump operation time reaches or exceeds the set pump time.

The storage unit 34 stores, in advance, various setting values to be used by the comparison unit 32. More specifically, the storage unit 34 stores the set air-conditioning time as a threshold for the air-conditioning operation time, and the set pump time as a threshold for the pump operation time.

Figure 3:
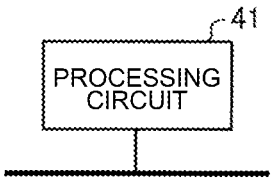
FIG. 3 is a hardware configuration diagram illustrating an example of the configuration of the controller of FIG. 2.

FIG. 3 is a hardware configuration diagram illustrating an example of the configuration of the controller 3 of FIG. 2. When various functions of the controller 3 are executed by hardware, the controller 3 of FIG. 2 is of a processing circuit 41, as shown in FIG. 3. The respective functions of the count unit 31, the comparison unit 32, the device control unit 33, and the storage unit 34 of FIG. 2 are achieved by the processing circuit 41.

When each function is executed by hardware, the processing circuit 41 corresponds to, for example, a single circuit, a composite circuit, a programmed processor, a parallel-programed processor, an application specific integrated circuit (ASIC), a field-programmable gate array (FPGA), or a combination of those circuits. The respective functions of the count unit 31, the comparison unit 32, the device control unit 33, and the storage unit 34 may be achieved by respective processing circuits 41 or may be achieved by a single processing circuit 41.

Figure 4:
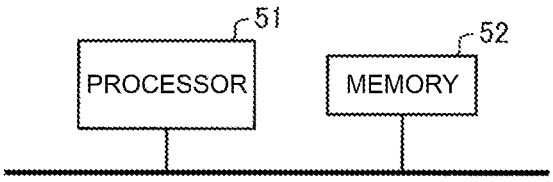
FIG. 4 is a hardware configuration diagram illustrating another example of the configuration of the controller of FIG. 2.

FIG. 4 is a hardware configuration diagram illustrating another example of the configuration of the controller 3 of FIG. 2. When various functions of the controller 3 are executed by software, the controller 3 of FIG. 2 comprises a processor 51 and a memory 52, as shown in FIG. 4. The respective functions of the count unit 31, the comparison unit 32, the device control unit 33, and the storage unit 34 of FIG. 2 are achieved by the processor 51 and the memory 52.

When each function is executed by software, the respective functions of the count unit 31, the comparison unit 32, and the device control unit 33 are achieved by software, firmware, or a combination of software and firmware. The software and the firmware are described as programs and are stored in the memory 52. The processor 51 is configured to read out and execute corresponding programs stored in the memory 52, to thereby achieve the respective functions of the units.

The memory 52 is, for example, a non-volatile or volatile semiconductor memory, such as a random access memory (RAM), a read only memory (ROM), a flash memory, an erasable and programmable ROM (EPROM), or an electrically erasable and programmable ROM (EEPROM). In addition, a removable recording medium, such as a magnetic disk, a flexible disk, an optical disc, a compact disc (CD), a mini disc (MD), or a digital versatile disc (DVD), may be used as the memory 52.

[Formation of Oxide Film]

Formation of an oxide film at a connection portion of each device (hereinafter referred to as "heat medium device" as appropriate) installed on the heat medium circulation circuit 5 and the heat medium pipe 5*a*. An example in which the indoor heat exchanger 23 as a heat medium device and the heat medium pipe 5*a* are connected will be explained below. In the following explanation, "the connection portion of the indoor heat exchanger 23 and the heat medium pipe 5*a*" may be referred to simply as "the connection portion" as appropriate.

In general, in the indoor heat exchanger 23 and the heat medium pipe 5*a*, copper is used as a metal material. To connect the indoor heat exchanger 23 to the heat medium pipe 5*a*, a brazing material containing silver is used as a connection material. That is, because a different kind of metal is used to connect the indoor heat exchanger 23 and the heat medium pipe 5*a*, the connection portion of the indoor heat exchanger 23 and the heat medium pipe 5*a* is in a state in which different metals are made contact with each other. Consequently, corrosion occurs at the connection portion due to the contact of different metals.

Meanwhile, when the heat medium is circulated in the heat medium circulation circuit 5, an oxide film is formed at the connection portion of the indoor heat exchanger 23 and the heat medium pipe 5*a*. Because the oxide film is formed and covers the connection portion, the different metals hardly come into contact with each other, and thus progression of the corrosion is reduced.

However, when the heat medium is not circulated in the heat medium circulation circuit 5 for a certain period of time or when the heat medium is in a stagnation state, an oxide film is not formed because the amount of oxygen supplied to the connection portion of the indoor heat exchanger 23 and the heat medium pipe 5*a* is reduced. Consequently, in such a case, an oxide film is not formed and corrosion progresses at the connection portion.

Therefore, in Embodiment 1, oxide film forming processing that enhances the formation of an oxide film on the connection portion is performed by controlling driving of the pump 22 to cause the heat medium to flow adequately in the heat medium circulation circuit 5. Note that, although described above is the formation of the oxide film on the connection portion of the indoor heat exchanger 23, the same applies to the connection portions of other heat medium devices.

[Oxide Film Forming Processing]

The oxide film forming processing in the air-conditioning apparatus 100 according to Embodiment 1 will be explained. In this oxide film forming processing, the formation of an oxide film at the connection portion of the heat medium device and the heat medium pipe 5*a* is enhanced based on a state of the heat medium pipe 5*a*.

Figure 5:
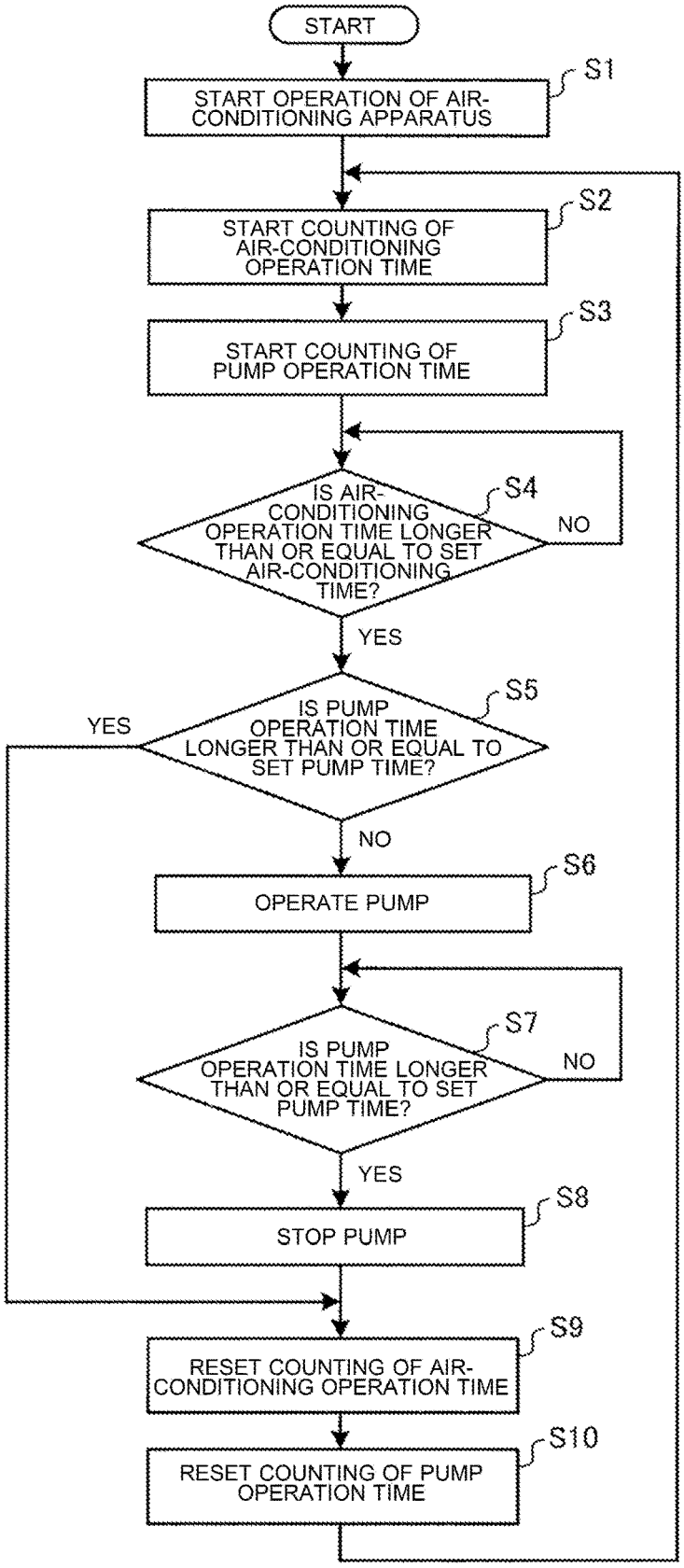
FIG. 5 is a flowchart illustrating an example of a flow of oxide film forming processing according to Embodiment 1.

FIG. 5 is a flowchart illustrating an example of a flow of the oxide film forming processing according to Embodiment 1. First, when operation of the air-conditioning apparatus 100 is started in step S1, the count unit 31 starts counting of the air-conditioning operation time in step S2. Then, in step S3, the count unit 31 starts counting of the pump operation time based on the heat medium detection information supplied from the flowmeter 24.

In step S4, the comparison unit 32 compares the air-conditioning operation time counted by the count unit 31 with the set air-conditioning time stored in the storage unit 34. This comparison is performed to determine whether or not an elapsed time after the operation of the air-conditioning apparatus 100 has started reaches a time that the presence or absence of an oxide film at the connection portion of the heat medium device and the heat medium pipe 5*a* can be determined.

When the comparison result indicates that the air-conditioning operation time is longer than or equal to the set air-conditioning time (Yes in step S4), it is determined that the time that the presence or absence of an oxide film can be determined is reached, and the process proceeds to step S5. Meanwhile, when the air-conditioning operation time does not reach the set air-conditioning time (No in step S4), it is determined that the time that the presence or absence of an oxide film can be determined is not reached, and the process returns to step S4. Then, the process of step S4 is repeated until the air-conditioning operation time reaches the set air-conditioning time.

In step S5, the comparison unit 32 compares the pump operation time counted by the count unit 31 with the set pump time stored in the storage unit 34. This comparison is performed to determine whether or not a time during which the heat medium flows in the heat medium pipe 5*a* reaches a time that formation of an oxide film can be determined.

When the comparison result indicates that the pump operation time is longer than or equal to the set pump time (Yes in step S5), it is determined that an oxide film is formed already, and the process proceeds to step S9. Meanwhile, when the pump operation time does not reach the set pump time, (No in step 35), it is determined that an oxide film is not formed yet. Then, in step 36, the device control unit 33 controls driving of the pump 22 to operate the pump 22. Consequently, the heat medium is thus caused to circulate in the heat medium circulation circuit 5, and thereby the formation of an oxide film is enhanced at the connection portion of the heat medium device and the heat medium pipe 5*a*.

In step 37, the comparison unit 32 compares again the pump operation time counted by the count unit 31 with the set pump time stored in the storage unit 34. When the comparison result indicates that the pump operation time is longer than or equal to the set pump time (Yes in step 37), it is determined that an oxide film is formed already. Then, in step 38, the device control unit 33 controls driving of the pump 22 to stop the operation of the pump 22. Meanwhile, when the pump operation time does not reach the set pump time (No in step S), it is determined that an oxide film is not formed yet, and the process returns to step 37. Then, the process of step S7 is repeated until the pump operation time reaches or exceeds the set pump time.

In step S9, the device control unit 33 resets the air-conditioning operation time counted by the count unit 31. In step 310, the device control unit 33 resets the pump operation time counted by the count unit 31. Then, while the operation of the air-conditioning apparatus 100 continues, the processes of steps S2 to 310 are repeated.

As described above, in Embodiment 1, driving of the pump 22 is controlled so that the operation time of the pump 22 reaches or exceeds the set pump time. As a result, even when the heat medium does not flow in the heat medium circulation circuit 5 for a long time, the heat medium is forcibly flowed and thus the formation of an oxide film at the connection portion of the heat medium device and the heat medium pipe 5*a* can be enhanced. Consequently, because the oxide film is formed, corrosion at the connection portion can be prevented.

First Modification Example

Next, a first modification example of Embodiment 1 will be explained. In the first modification example, the pump 22 is used as the heat medium detection unit, and the presence or absence of a flow of the heat medium in the heat medium circulation circuit 5 is detected based on the rotation speed of the pump 22 installed on the heat medium circulation circuit 5.

Figure 6:
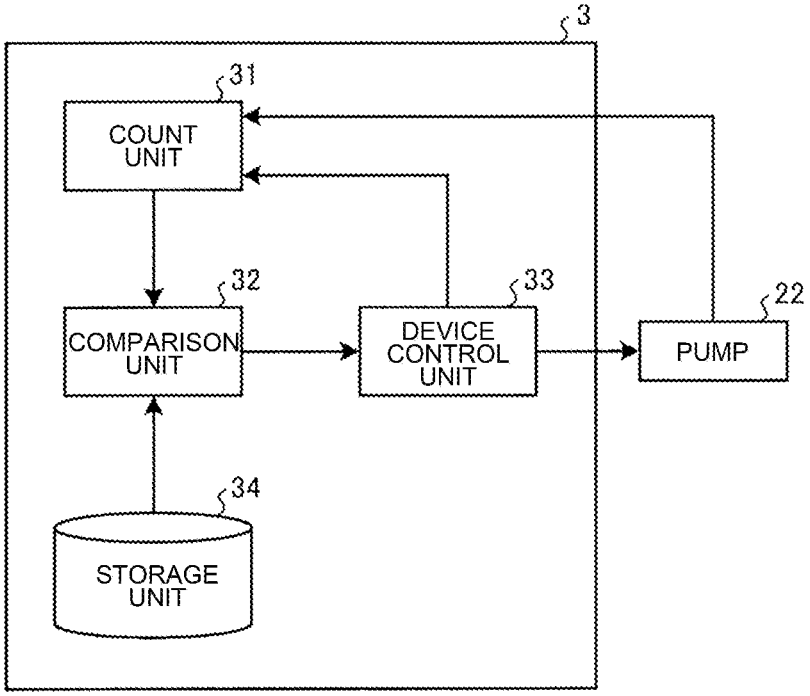
FIG. 6 is a functional block diagram illustrating an example of a configuration of a controller 3 according to a first modification example of Embodiment 1.

FIG. 6 is a functional block diagram illustrating an example of a configuration of the controller 3 according to the first modification example of Embodiment 1. As shown in FIG. 6, in the first modification example, the pump 22 is configured to output rotation speed information indicating the rotation speed of the pump 22 in discharging the heat medium. The rotation speed information is output to the count unit 31 of the controller 3. Based on the rotation speed information supplied from the pump 22, the count unit 31 counts the pump operation time, which is the operation time of the pump 22.

As described above, in the first modification example, the pump operation time is counted based on the rotation speed information supplied from the pump 22. Thus, driving of the pump 22 is controlled so that the pump operation time counted by the count unit 31 reaches or exceeds the set pump time. Consequently, as with Embodiment 1, the formation of an oxide film at the connection portion can be enhanced.

Second Modification Example

Next, a second modification example of Embodiment 1 will be explained. In the second modification example, an input-output differential pressure switch is used as the heat medium detection unit. The input-output differential pressure switch is configured to detect pressures of the heat medium before and after the heat medium flows in the heat medium pipe 5*a*. In this case, the count unit 31 counts the pump operation time of the pump 22 based on the detection results of the input-output differential pressure switch.

As described above, in the second modification example, the pump operation time is counted based on the detection results supplied from the input-output differential pressure switch. Thus, driving of the pump 22 is controlled so that the pump operation time counted by the count unit 31 reaches or exceeds the set pump time. Consequently, as with Embodiment 1 and the first modification example, the formation of an oxide film at the connection portion can be enhanced.

As described above, in the air-conditioning apparatus 100 of Embodiment 1, the device control unit 33 controls driving of the pump 22 based on the comparison results by the comparison unit 32 so that the pump operation time in the set air-conditioning time reaches or exceeds the set pump time. As a result, the heat medium is forcibly circulated in the heat medium circulation circuit 5 and thus a case where the heat medium is not circulated for a certain period of time can be avoided. Consequently, the formation of an oxide film at the connection portion of the heat medium device and the heat medium pipe 5*a* is enhanced, and thus the corrosion can be prevented from occurring at the connection portion.

In addition, in the air-conditioning apparatus 100, the flowmeter 24, the pump 22, or the input-output differential pressure switch is used as the heat medium detection unit. With this detection unit, a state of the heat medium in the heat medium circulation circuit 5 can be detected.

Embodiment 2

Next, Embodiment 2 of the present disclosure will be explained. Embodiment 2 is different from Embodiment 1 in that the set pump time is determined based on the temperature of the heat medium circulating in the heat medium circulation circuit 5. In the description below, differences from Embodiment 1 will be mainly explained.

[Configuration of Air-Conditioning Apparatus 200]

Figure 7:
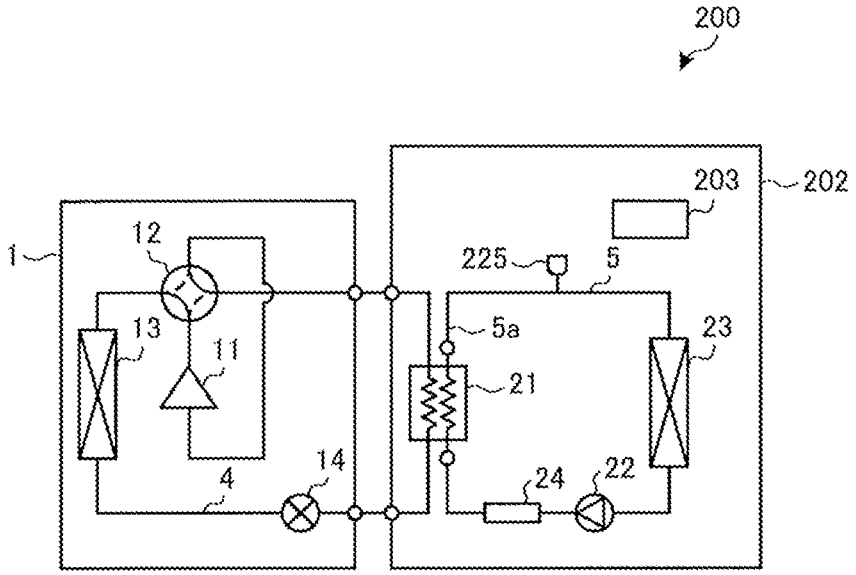
FIG. 7 is a schematic diagram illustrating an example of a configuration of an air-conditioning apparatus according to Embodiment 2.

FIG. 7 is a schematic diagram illustrating an example of a configuration of an air-conditioning apparatus 200 according to Embodiment 2. As shown in FIG. 7, the air-conditioning apparatus 100 includes the outdoor unit 1, an indoor unit 202, and a controller 203.

(Indoor Unit 202)

The indoor unit 202 includes the heat medium heat exchanger 21, the pump 22, the indoor heat exchanger 23, the flowmeter 24, and a water temperature meter 225. The heat medium heat exchanger 21, the pump 22, the indoor heat exchanger 23, and the flowmeter 24 are annularly connected by the heat medium pipe 5*a* to form the heat medium circulation circuit 5, in which the heat medium is circulated. The water temperature meter 225 is configured to detect the temperature of the heat medium circulating in the heat medium circulation circuit 5 and output heat medium temperature information indicating the detection result.

(Controller 203)

Figure 8:
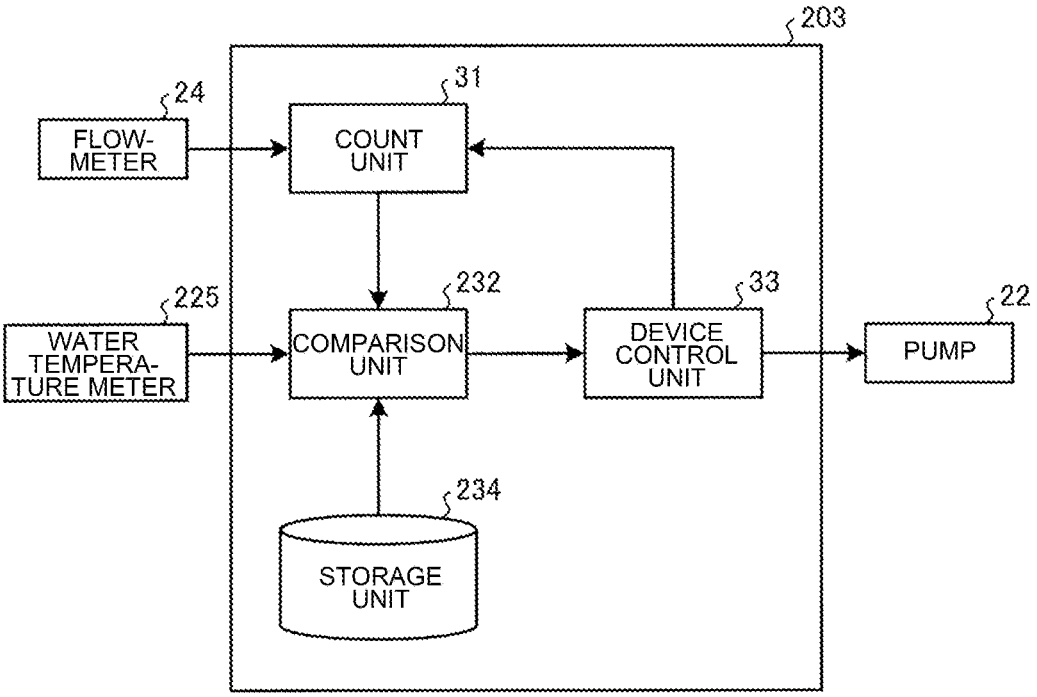
FIG. 8 is a functional block diagram illustrating an example of a configuration of a controller of FIG. 7.

FIG. 8 is a functional block diagram illustrating an example of a configuration of the controller 203 of FIG. 7. As shown in FIG. 8, the controller 203 includes the count unit 31, a comparison unit 232, the device control unit 33, and a storage unit 234. The controller 203 achieves various functions by executing software on an arithmetic device such as a microcomputer, or is made of hardware such as a circuit device, which achieves various functions.

In Embodiment 2, the storage unit 234 stores an arithmetic equation for determining a set pump time from the temperature of the heat medium. By using the arithmetic equation, a prediction time when an oxide film is formed can be calculated from the temperature of the heat medium. Based on the heat medium temperature detected by the water temperature meter 225, the comparison unit 232 determines the set pump time by using the arithmetic equation stored in the storage unit 234. Then, the comparison unit 232 compares the determined set pump time with the pump operation time counted by the count unit 31.

Here, when various functions of the controller 203 are executed by hardware, the controller 203 of FIG. 8 is the processing circuit 41 shown in FIG. 3, as with Embodiment 1. The respective functions of the count unit 31, the comparison unit 232, the device control unit 33, and the storage unit 234 of FIG. 8 are achieved by the processing circuit 41.

In addition, when various functions of the controller 203 are executed by software, the controller 203 of FIG. 8 comprises the processor 51 and the memory 52 shown in FIG. 4, as with Embodiment 1. The respective functions of the count unit 31, the comparison unit 232, the device control unit 33, and the storage unit 234 of FIG. 8 are achieved by the processor 51 and the memory 52.

[Oxide Film Forming Processing]

The oxide film forming processing in the air-conditioning apparatus 200 according to Embodiment 2 will be explained. In Embodiment 2, the oxide film forming processing shown in FIG. 5 is performed, as with Embodiment 1.

In this case, in step S5 and step S7 of FIG. 5, the comparison unit 232 determines the set pump time by using the arithmetic equation stored in the storage unit 234 based on the heat medium temperature detected by the water temperature meter 225. Then, the comparison unit 232 compares the determined set pump time with the pump operation time, and determines whether or not the time during which the heat medium flows in the heat medium pipe 5*a* reaches a time that formation of an oxide film can be determined.

As described above, in Embodiment 2, the set pump time is determined based on the temperature of the heat medium circulating in the heat medium circulation circuit 5. Consequently, because the pump operation time for forming an oxide film is accurately determined according to the temperature of the heat medium, an oxide film can be formed appropriately.

Note that, in this example, the set pump time is determined by using the arithmetic equation, but the method for determining the set pump time is not limited thereto. For example, a table in which a heat medium temperature and a set pump time are associated with each other is stored in the storage unit 234 in advance, and by referring to the table, the comparison unit 232 may determine the set pump time based on the heat medium temperature.

As described above, in the air-conditioning apparatus 200 according to Embodiment 2, the set pump time is determined according to the temperature of the heat medium detected by the water temperature meter 225, and driving of the pump 22 is controlled based on the determined set pump time. Consequently, whether or not an oxide film has been formed can be accurately determined, and thus an oxide film can be formed appropriately.

Embodiment 3

Next, Embodiment 3 of the present disclosure will be explained. An oxide film at the connection portion of the heat medium device and the heat medium pipe 5*a* is formed when the heat medium is circulated in the heat medium circulation circuit 5, however, there is a case in which the oxide film may be peeled off and lost when a flow velocity of the circulating heat medium is high. Therefore, in Embodiment 3, when the formed oxide film is lost, an oxide film is re-formed by controlling driving of the pump 22.

[Configuration of Air-Conditioning Apparatus 300]

Figure 9:
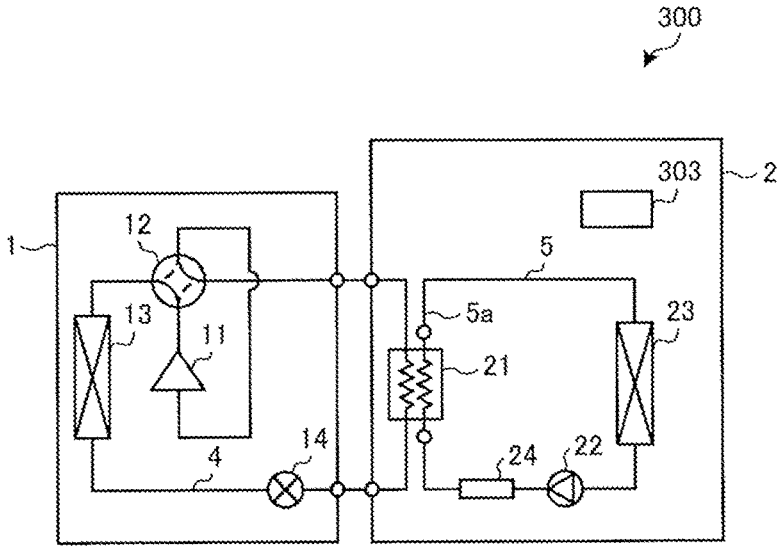
FIG. 9 is a schematic diagram illustrating an example of a configuration of an air-conditioning apparatus according to Embodiment 3.

FIG. 9 is a schematic diagram illustrating an example of a configuration of an air-conditioning apparatus 300 according to Embodiment 3. As shown in FIG. 9, the air-conditioning apparatus 300 includes the outdoor unit 1, the indoor unit 2, and a controller 303.

(Controller 303)

The controller 303 is configured to control operation of the whole air-conditioning apparatus 300 including the outdoor unit 1 and the indoor unit 2, based on various types of information received from various sensors provided at respective sections of the air-conditioning apparatus 300. In particular, in Embodiment 3, the controller 303 controls driving of the pump 22 based on the operation time of the air-conditioning apparatus 300 and the flow velocity of the heat medium.

Figure 10:
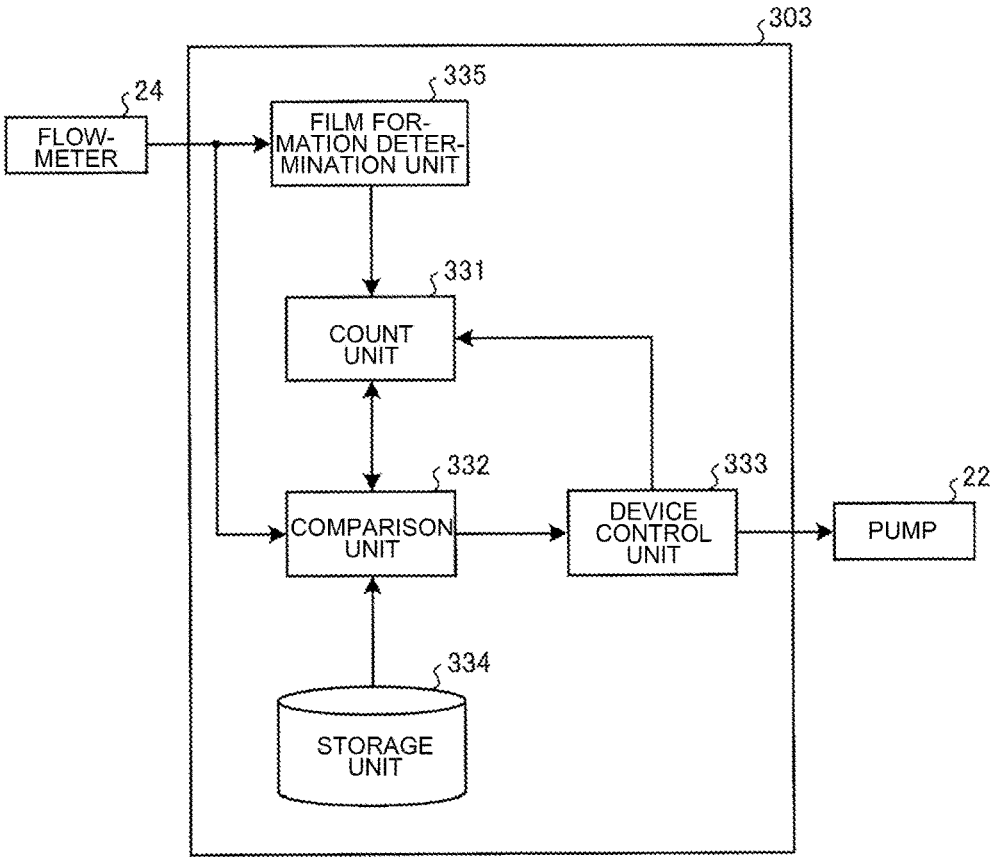
FIG. 10 is a functional block diagram illustrating an example of a configuration of a controller of FIG. 9.

FIG. 10 is a functional block diagram illustrating an example of a configuration of the controller 303 of FIG. 9. As shown in FIG. 10, the controller 303 includes a count unit 331, a comparison unit 332, a device control unit 333, a storage unit 334, and a film formation determination unit 335. The controller 303 achieves various functions by executing software on an arithmetic device such as a microcomputer, or is made of hardware such as a circuit device, which achieves various functions.

The film formation determination unit 335 is configured to determine whether or not an oxide film is present at the connection portion of the heat medium device and the heat medium pipe 5*a* based on the heat medium detection information supplied from the flowmeter 24. The count unit 331 is configured to count an air-conditioning operation time in which an oxide film is not present, based on the determination result by the film formation determination unit 335. In addition, the count unit 331 is configured to count a pump operation time of the pump 22 based on a comparison result by the comparison unit 332. The air-conditioning operation time and the pump operation time counted by the count unit 331 will be reset by the device control unit 333.

The comparison unit 332 is configured to compare the air-conditioning operation time counted by the count unit 331 with the set air-conditioning time stored in the storage unit 334. In addition, the comparison unit 332 is configured to compare the pump operation time counted by the count unit 331 with the set pump time stored in the storage unit 334.

Furthermore, the comparison unit 332 is configured to compare the flow velocity of the heat medium circulating in the heat medium circulation circuit 5 with a set flow velocity stored in the storage unit 334 based on the heat medium detection information supplied from the flowmeter 24. The set flow velocity is a threshold for the flow velocity of the heat medium, and is set to such a flow velocity that a formed oxide film is not peeled off from the connection portion, for example.

The device control unit 333 is configured to control driving of the pump 22 based on the comparison results by the comparison unit 332. More specifically, the device control unit 333 causes the pump 22 to operate when the air-conditioning operation time is longer than or equal to the set air-conditioning time and the flow velocity of the heat medium is faster than or equal to the set flow velocity. In addition, the device control unit 333 resets the air-conditioning operation time and the pump operation time counted by the count unit 331 when the pump operation time reaches or exceeds the set pump time. The storage unit 334 stores, in advance, the set air-conditioning time, the set pump time, and the set flow velocity to be used by the comparison unit 332.

Here, when various functions of the controller 303 are executed by hardware, the controller 303 of FIG. 10 is the processing circuit 41 shown in FIG. 3, as with Embodiments 1 and 2. The respective functions of the count unit 331, the comparison unit 332, the device control unit 333, the storage unit 334, and the film formation determination unit 335 of FIG. 10 are achieved by the processing circuit 41.

When various functions of the controller 303 are executed by software, the controller 303 of FIG. 10 comprises the processor 51 and the memory 52 shown in FIG. 4, as with Embodiments 1 and 2. The respective functions of the count unit 331, the comparison unit 332, the device control unit 333, the storage unit 334, and the film formation determination unit 335 of FIG. 10 are achieved by the processor 51 and the memory 52.

(Oxide Film Re-Forming Processing)

The oxide film re-forming processing of the air-conditioning apparatus 300 according to Embodiment 3 will be explained. In this oxide film re-forming processing, when the oxide film formed at the connection portion of the heat medium device and the heat medium pipe 5*a* is lost during operation of the air-conditioning apparatus 300, the pump 22 is forcibly operated to re-form an oxide film.

Figure 11:
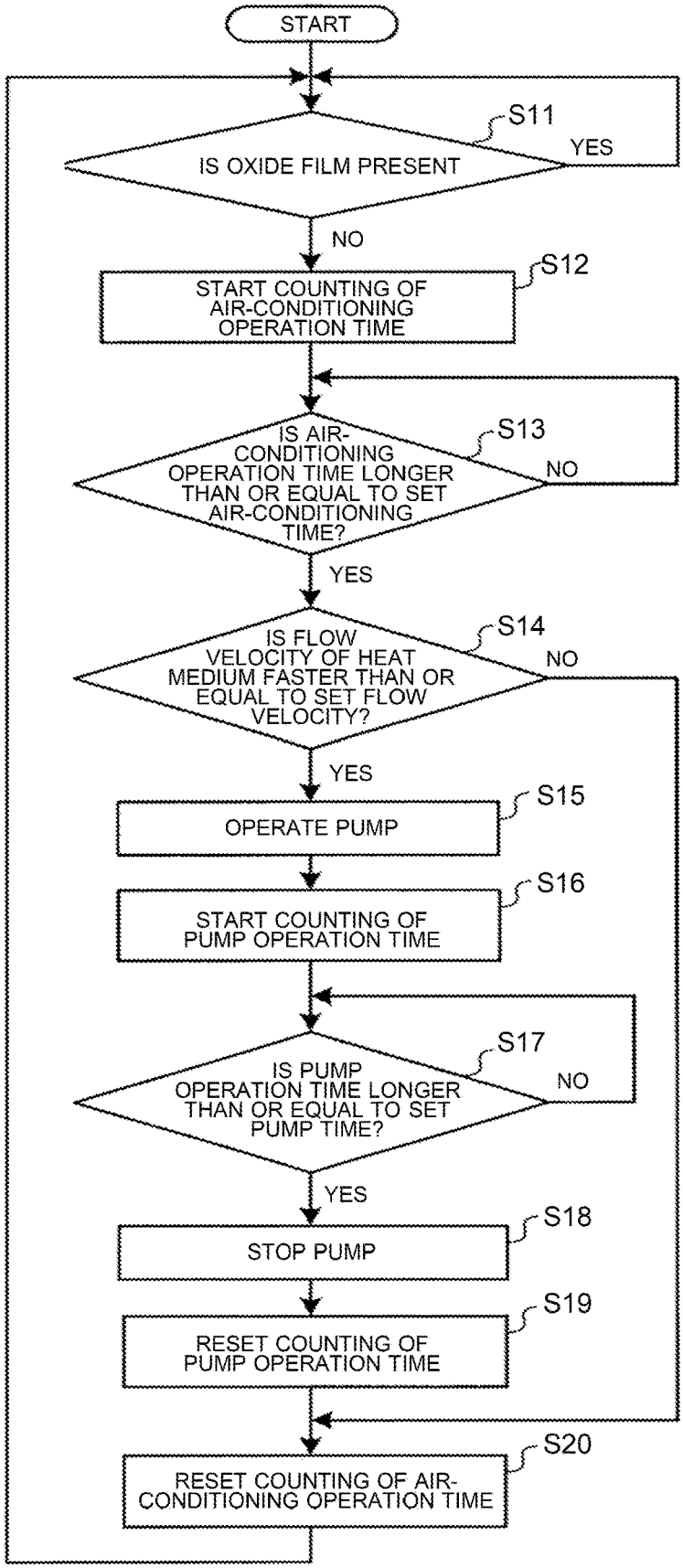
FIG. 11 is a flowchart illustrating an example of a flow of oxide film re-forming processing according to Embodiment 3.

FIG. 11 is a flowchart illustrating an example of a flow of oxide film re-forming processing according to Embodiment 3. First, in step S11, the film formation determination unit 335 determines whether or not an oxide film is present at the connection portion of the heat medium and the heat medium pipe 5*a* based on the heat medium detection information supplied from the flowmeter 24. The presence or absence of an oxide film is determined based on the flow rate of the heat medium circulated in the heat medium circulation circuit 5 and the pump operation time during which the heat medium circulates.

When it is determined that an oxide film is present at the connection portion (Yes in step S11), the process returns to step S11. Meanwhile, when it is determined that an oxide film is not present at the connection portion (No in step S11), the count unit 331 starts counting of the air-conditioning operation time in step S12.

In step S13, the comparison unit 332 compares the air-conditioning operation time counted by the count unit 331 with the set air-conditioning time stored in the storage unit 334. When the comparison result indicates that the air-conditioning operation time is longer than or equal to the set air-conditioning time (Yes in step S13), it is determined that the time required for forming an oxide film is reached, and the process proceeds to step S14. Meanwhile, when the air-conditioning operation time does not reach the set air-conditioning time (No in step S13), it is determined that the time required for forming an oxide film is not reached, and the process returns to step S13. Then, the process of step S13 is repeated until the air-conditioning operation time reaches the set air-conditioning time.

In step S14, the comparison unit 332 compares the flow velocity of the heat medium obtained based on the heat medium detection information supplied from the flowmeter 24 with the set flow velocity stored in the storage unit 34. This comparison is performed to determine whether or not the heat medium circulates at a flow velocity at which an oxide film is lost or faster. When the comparison result indicates that the flow velocity of the heat medium is slower than the set flow velocity (No in step S14) it is determined that the oxide film is not lost, and the process proceeds to step 320.

Meanwhile, when the flow velocity of the heat medium is faster than or equal to the set flow velocity (Yes in step S14), it is determined that the oxide film is lost. Therefore, in step S15, the device control unit 333 controls driving of the pump 22 to operate the pump 22. At that time, the device control unit 333 controls driving of the pump 22 so that the heat medium is circulated at such a flow velocity that an oxide film will not be lost, that is, at the flow velocity slower than the set flow velocity. Consequently, the heat medium is circulated in the heat medium circulation circuit 5 at such a flow velocity that an oxide film will not be lost, and an oxide film is re-formed at the connection portion of the heat medium device and the heat medium pipe 5*a*.

In addition, in step S16, the count unit 331 starts counting of the pump operation time after the pump 22 starts operation, based on the comparison results by the comparison unit 332 obtained in steps S13 and S14.

In step S17, the comparison unit 332 compares the pump operation time counted by the count unit 331 with the set pump time stored in the storage unit 34. The comparison result indicates that the pump operation time is longer than or equal to the set pump time (Yes in step S17), it is determined that an oxide film is formed already. Then, in step S18, the device control unit 333 controls driving of the pump 22 to stop the operation of the pump 22. Meanwhile, when the pump operation time does not reach the set pump time (No in step S17), it is determined that an oxide film is not formed yet, and the process returns to step S17. Then, the process of the step S17 is repeated until the pump operation time reaches or exceeds the set pump time.

In step S19, the device control unit 333 resets the pump operation time counted by the count unit 331. In step S20, the device control unit 333 resets the air-conditioning operation time counted by the count unit 331. Then, while the operation of the air-conditioning apparatus 300 continues, the processes of steps S11 to S20 are repeated.

As described above, in Embodiment 3, when the operation time of the air-conditioning apparatus 300 is longer than or equal to the set air-conditioning time and the flow velocity of the heat medium is faster than or equal to the set flow velocity, it is determined that an oxide film is lost, and the pump 22 is controlled to operate. As a result, even when an oxide film was lost, a new oxide film is formed again, and thus the connection portion of the heat medium device and the heat medium pipe 5*a* can be prevented from corrosion.

Modification Example

Next, a modification example of Embodiment 3 will be explained. In this modification example, an outdoor air is taken into the heat medium circulation circuit 5 when the heat medium is circulated by operation of the pump 22, and thus re-forming of an oxide film is enhanced.

Figure 12:
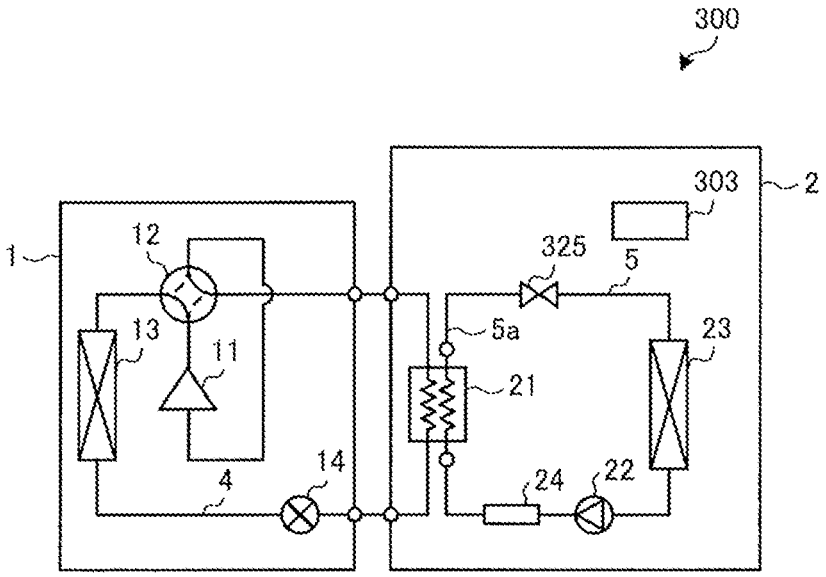
FIG. 12 is a schematic diagram illustrating an example of a configuration of an air-conditioning apparatus according to a modification example of Embodiment 3.

FIG. 12 is a schematic diagram illustrating an example of a configuration of the air-conditioning apparatus 300 according to a modification example of Embodiment 3. As shown in FIG. 12, a valve 325 is provided on the heat medium circulation circuit 5 in the indoor unit 2. The valve 325 is provided to introduce an outdoor air into the heat medium circulation circuit 5, and opening/closing of the valve 325 is controlled by the controller 303.

The oxide film re-forming processing is executed according to the flow shown in FIG. 11, as with Embodiment 3. Here, in the modification example, when operation of the pump 22 is started in step S15 of FIG. 11, the valve 325 is opened by the device control unit 333. Thus, an outdoor air is introduced into the heat medium circulation circuit 5.

When an air is introduced into the heat medium circulation circuit 5 as described above, more oxygen is supplied to the heat medium. As a result, oxygen is sufficiently supplied to the connection portion of the heat medium device and the heat medium pipe 5*a*, and thus an oxide film is re-formed more efficiently.

As described above, in the air-conditioning apparatus 300 of Embodiment 3, the presence or absence of an oxide film at the connection portion of the heat medium device and the heat medium pipe 5*a* is determined during operation. Then, when it is determined that an oxide film is not present and, at the same time, when the air-conditioning operation time is longer than or equal to the set air-conditioning time and the flow velocity of the heat medium is faster than or equal to the set flow velocity, the pump 22 is controlled so that the pump drive time reaches or exceeds the set pump time. Consequently, when it is determined that an oxide film at the connection portion is lost, a new oxide film is formed again, and thus connection portion can be prevented from corrosion.

In addition, in air-conditioning apparatus 30 the valve 325 for taking in an outdoor air is installed on the heat medium circuit, and the valve 325 is opened when the pump 22 is operated. Consequently, more oxygen is supplied to the heat medium, and thus re-forming of an oxide film can be further enhanced.

Note that, the configuration, in which an outdoor air is introduced by using the valve 325, explained in the modification example of Embodiment 3 is not limited to Embodiment 3, but can be applied to Embodiments 1 and 2, too. In such a case, the air-conditioning apparatus 100 of Embodiment 1 shown in FIG. 1 and the air-conditioning apparatus 200 of Embodiment 2 shown in FIG. 7 are provided with the valves 325 on the heat medium circulation circuits 5, and when the pumps 22 are driven in the oxide film forming process, an outdoor air may be introduced to the heat medium circulation circuits 5.

Embodiment 4

Next, Embodiment 4 of the present disclosure will be explained. In Embodiments 1 to 3, the heat medium is forcibly circulated by driving the pump 22 when the time period in which the heat medium flows is shorter than the set air-conditioning time, however, there is a case where a user intentionally prevents the heat medium from circulating even during operation of the air-conditioning apparatus. When a process for forcibly circulating the heat medium is performed in such a case, the process may cause an unintended operation for the user.

However, corrosion is caused at the connection portion of the heat medium device and the heat medium pipe 5*a* when the heat medium is prevented from circulating over a long period of time, and such corrosion is not beneficial to the user. Therefore, in Embodiment 4, when the heat medium is not circulated for a long time, the user is notified that corrosion may progress at the connection portion.

[Configuration of Air-Conditioning Apparatus 400]

Figure 13:
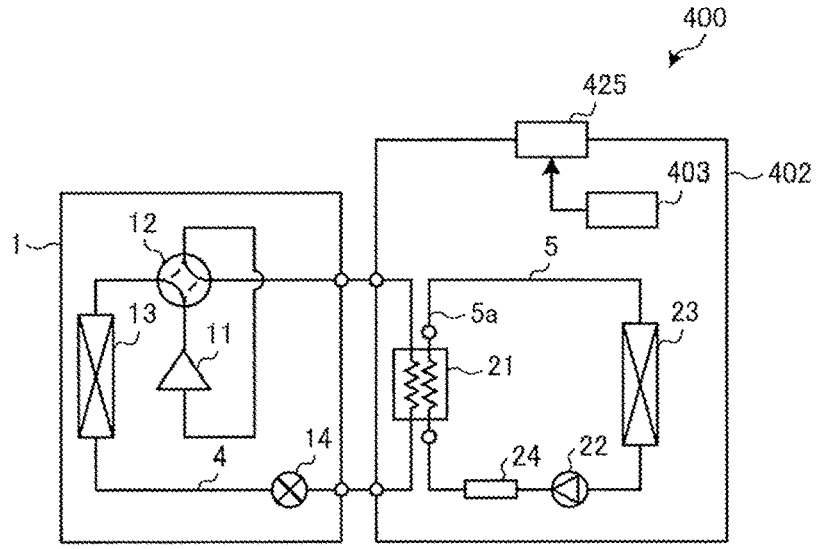
FIG. 13 is a schematic diagram illustrating an example of a configuration of an air-conditioning apparatus according to Embodiment 4.

FIG. 13 is a schematic diagram illustrating an example of a configuration of an air-conditioning apparatus 400 according to Embodiment 4. As shown in FIG. 13, the air-conditioning apparatus 400 includes the outdoor unit 1, an indoor unit 402, and a controller 403.

(Indoor Unit 402) The indoor unit 402 includes the heat medium heat exchanger 21, the pump 22, the indoor heat exchanger 23, the flowmeter 24, and a notification unit 425. The heat medium heat exchanger 21, the pump 22, the indoor heat exchanger 23, and the flowmeter 24 are annularly connected by the heat medium pipe 5*a* to form the heat medium circulation circuit 5, in which the heat medium is circulated.

The notification unit 425 is installed on a casing of the indoor unit 402, for example, and is configured to notify the user of information indicating a possibility of occurrence of corrosion at the connection portion of the heat medium device and the heat medium pipe 5*a*. As the notification unit 425, used is a display device such as, for example, a display or a light emitting diode (LED), which visually displays information to be notified. In addition, the notification unit 425 is not limited to such a display device, but may be an audio output device such as a speaker, which informs the user about information to be notified by sound. Note that, although the notification unit 425 is installed on the indoor unit 402, the notification unit 425 may be installed on a remote controller (not shown).

(Controller 403)

The controller 403 is configured to control operation of the whole air-conditioning apparatus 400 including the outdoor unit 1 and the indoor unit 402, based on various types of information received from various sensors provided at respective sections of the air-conditioning apparatus 400. In particular, in Embodiment 4, the controller 403 controls the notification unit 425 in the indoor unit 402 based on the operation time of the air-conditioning apparatus 400 and the flow velocity of the heat medium.

Figure 14:
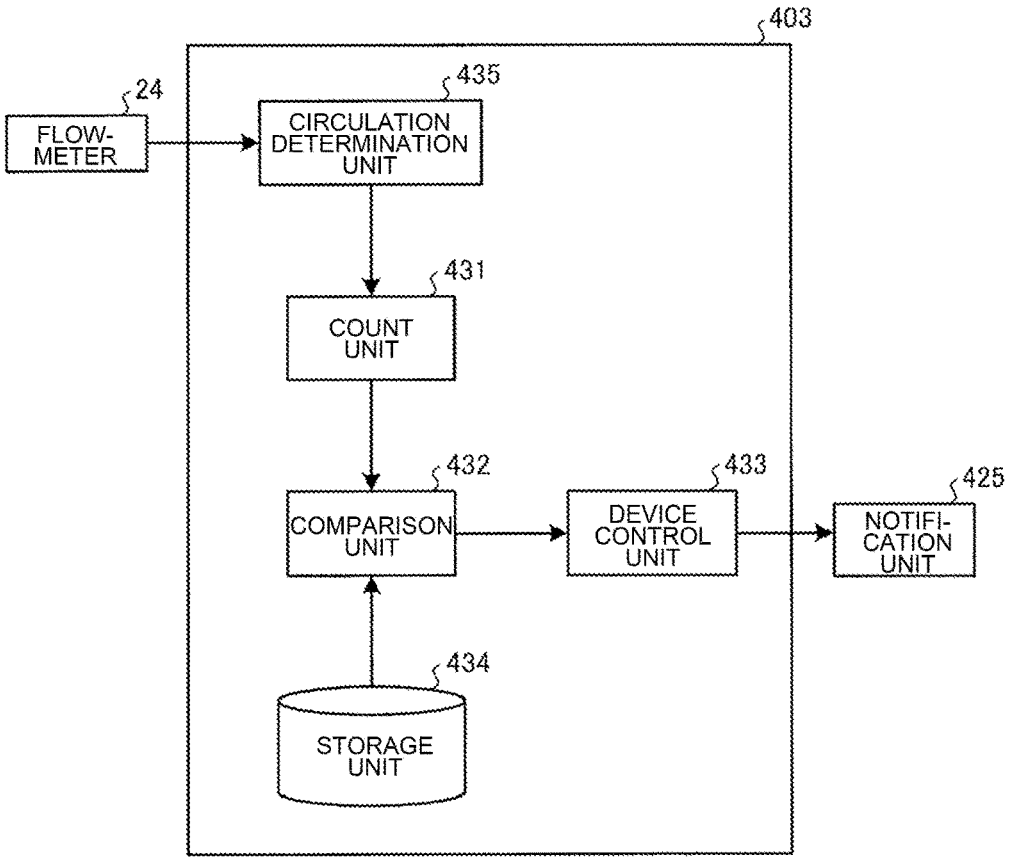
FIG. 14 is a functional block diagram illustrating an example of a configuration of a controller of FIG. 13.

FIG. 14 is a functional block diagram illustrating an example of a configuration of the controller 403 of FIG. 13. As shown in FIG. 14, the controller 403 includes a count unit 431, a comparison unit 432, a device control unit 433, a storage unit 434, and a circulation determination unit 435. The controller 403 achieves various functions by executing software on an arithmetic device such as a microcomputer, or is made of hardware such as a circuit device, which achieves various functions.

The circulation determination unit 435 is configured to determine whether or not the heat medium is circulated in the heat medium circulation circuit 5 based on the heat medium detection information supplied from the flowmeter 24. The comparison unit 432 is configured to compare the air-conditioning operation time counted by the count unit 431 with the set air-conditioning time stored in the storage unit 434.

The device control unit 433 is configured to control the notification unit 425 based on the comparison result by the comparison unit 432. More specifically, the device control unit 433 is configured to generate a notification signal for outputting information to be notified and supply the signal to the to the notification unit 425, when the air-conditioning operation time is longer than or equal to the set air-conditioning time. The storage unit 434 stores, in advance, the set air-conditioning time to be used by the comparison unit 432.

Here, when various functions of the controller 403 are executed by hardware, the controller 403 of FIG. 14 is the processing circuit 41 shown in FIG. 3, as with Embodiments 1 to 3. The respective functions of the count unit 431, the comparison unit 432, the device control unit 433, the storage unit 434, and the circulation determination unit 435 of FIG. 14 are achieved by the processing circuit 41.

In addition, when various functions of the controller 403 are executed by software, the controller 403 of FIG. 14 comprises the processor 51 and the memory 52 shown in FIG. 4, as with Embodiments 1 to 3. The respective functions of the count unit 431, the comparison unit 432, the device control unit 433, the storage unit 434, and the circulation determination unit 435 of FIG. 14 are achieved by the processor 51 and the memory 52.

(Notification Processing)

The notification processing in the air-conditioning apparatus 400 according to Embodiment 4 will be explained. In this notification processing, when, during operation of the air-conditioning apparatus 400, the time period in which the heat medium is circulated in the heat medium circulation circuit 5 is shorter than the set air-conditioning time, the notification unit 425 notifies the user of a possibility of occurrence of corrosion at the connection portion.

Figure 15:
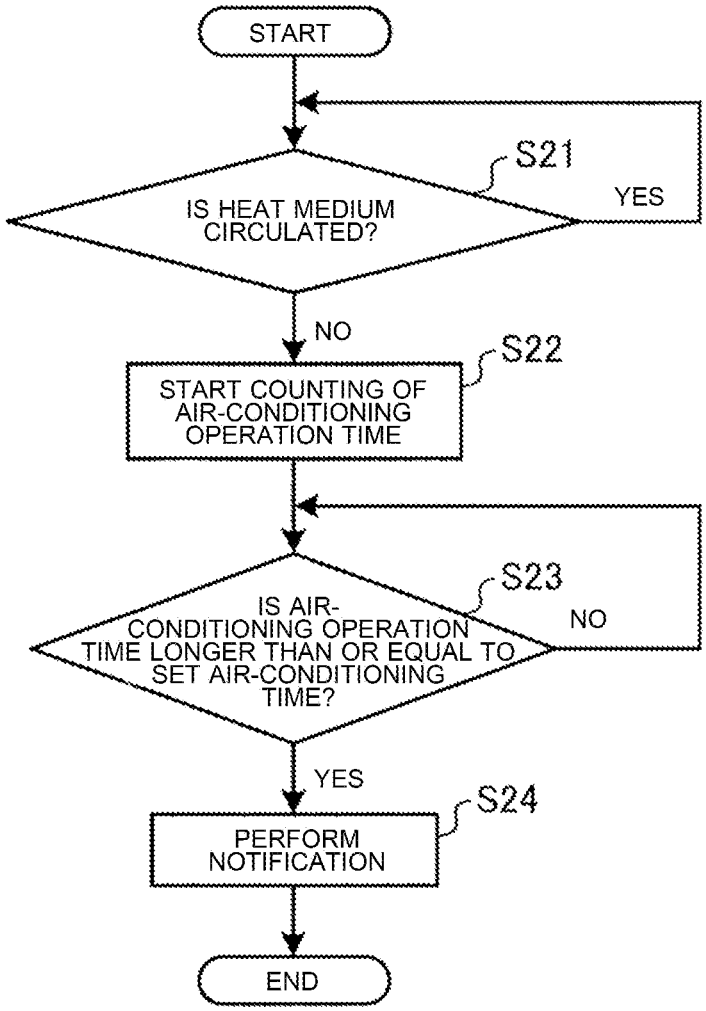
FIG. 15 is a flowchart illustrating an example of a flow of notification processing according to Embodiment 4.

FIG. 15 is a flowchart illustrating an example of a flow of notification processing according to Embodiment 4. First, in step S21, the circulation determination unit 435 determines whether or not the heat medium is circulated in the heat medium circulation circuit 5 based on the heat medium detection information supplied from the flowmeter 24. When it is determined that the heat medium is circulated (Yes in step S21), the process returns to step S21. Meanwhile, when it is determined that the heat medium is not circulated (No in step S21), the count unit 431 starts counting of the air-conditioning operation time in step S22.

In step 323, the comparison unit 432 compares the air-conditioning operation time counted by the count unit 431 with the set air-conditioning time stored in the storage unit 434. When the comparison result indicates that the air-conditioning operation time is longer than or equal to the set air-conditioning time (Yes in step S23), it is determined that there is a possibility of occurrence of corrosion at the connection portion, and the process proceeds to step S24. Meanwhile, when the air-conditioning operation time is shorter than the set air-conditioning time (No in step S23), it is determined that the connection portion is less likely to be corroded, and the process returns to step 323. Then, the process of step 323 is repeated until the air-conditioning operation time reaches the set air-conditioning time.

In step S24, the device control unit 333 generates information to be notified and supplies the information to the notification unit 425. With this information, the notification unit 425 notifies the user of a possibility of occurrence of corrosion at the connection portion.

As described above, in Embodiment 4, when the operation time of the air-conditioning apparatus 400 is longer than or equal to the set air-conditioning time, the use is notified of a possibility of occurrence of corrosion at the connection portion of the heat medium device and the heat medium pipe 5*a*. Thus, the possibility of occurrence of corrosion can be informed to the user before the connection portion is corroded.

Note that, in the description of this example, when the operation time of the air-conditioning apparatus 400 is longer than or equal to the set air-conditioning time, only the notification processing is performed, but the operation is not limited thereto. In addition to the notification processing, the oxide film forming processing and oxide film re-forming processing may be performed, as needed.

As described above, in the air-conditioning apparatus 400 according to Embodiment 4, the notification unit 425 is provided, and when the heat medium is not circulated in the heat medium circulation circuit 5 and the air-conditioning operation time is longer than or equal to the set air-conditioning time, a possibility of corrosion is informed. Consequently, it is possible to notify the user of the possibility of corrosion.

REFERENCE SIGNS LIST

1 outdoor unit 2, 202, 402 indoor unit 3, 203, 303, 403 controller 4 refrigerant cycle circuit 5 heat medium circulation circuit 5*a* heat medium pipe 11 compressor 12 refrigerant flow switching device 13 outdoor heat exchanger 14 expansion device 21 heat medium heat exchanger 22 pump indoor heat exchanger 24 flowmeter 31, 331 count unit 32, 232, 332 comparison unit 33, 333 device control unit 34, 234, 334 storage unit 41 processing circuit 51 processor 52 memory 100, 200, 300, 400 air-conditioning apparatus 225 water temperature meter 335 film formation determination unit 325 valve 425 notification unit

The invention claimed is:

1. An air-conditioning apparatus comprising:

a heat medium circulation circuit in which a heat medium device and a heat medium pipe, which are made of a metal material, are connected to each other by using a connection material containing a different metal material from the metal material and in which a heat medium is circulated;

a pump provided on the heat medium circulation circuit and configured to circulate the heat medium;

a heat medium detection unit configured to detect a state of the heat medium circulated in the heat medium circulation circuit; and a controller configured to control the pump according to presence or absence of a flow of the heat medium, wherein the controller is configured to count an air-conditioning operation time indicating an operation time of the air-conditioning apparatus and count a pump operation time indicating an operation time of the pump based on heat medium detection information indicating a detection result by the heat medium detection unit, store a set air-conditioning time for the air-conditioning operation time and a set pump time for the pump operation time, compare the air-conditioning operation time counted with the set air-conditioning time stored and compare the pump operation time with the set pump time, and control driving of the pump so that the pump operation time reaches or exceeds the set pump time when the comparison results indicate that the air-conditioning operation time is longer than or equal to the set air-conditioning time and the pump operation time is shorter than the set pump time.

2. The air-conditioning apparatus of claim 1, further comprising a water temperature meter configured to detect temperature of the heat medium, wherein the set pump time is determined according to the temperature of the heat medium, and the controller determines the set pump time based on the temperature of the heat medium detected by the water temperature meter, and compares the pump operation time counted with the determined set pump time.

3. The air-conditioning apparatus of claim 1, wherein the controller is further configured to determine presence or absence of an oxide film formed at a connection portion of the heat medium device and the heat medium pipe, based on the heat medium detection information and the pump operation time, the controller stores a set flow velocity for a flow velocity of the heat medium, counts the air-conditioning operation time when determining that the oxide film is not present, compares the air-conditioning operation time with the set air-conditioning time and compares the flow velocity of the heat medium obtained based on the heat medium detection information with the set flow velocity when determining that the oxide film is not present, and controls driving of the pump so that the pump operation time in the set air-conditioning time reaches or exceeds the set pump time when the air-conditioning operation time is longer than or equal to the set air-conditioning time and the flow velocity of the heat medium is faster than or equal to the set flow velocity.

4. The air-conditioning apparatus of claim 1, further comprising a valve provided on the heat medium circulation circuit and configured to take an outdoor air into the heat medium circulation circuit, wherein the controller opens the valve when controlling driving of the pump.

5. The air-conditioning apparatus of claim 1, further comprising a notification unit configured to notify a user of a state of a connection portion of the heat medium device and the heat medium pipe, wherein the controller is further configured to determine whether or not the heat medium is circulated in the heat medium circulation circuit based on the heat medium detection information, and when determining that the heat medium is not circulated in the heat medium circulation circuit, counts the air-conditioning operation time, compares the air-conditioning operation time counted with the set air-conditioning time, and controls the notification unit to notify the user of a possibility of corrosion at the connection portion when the comparison result indicates that the air-conditioning operation time is longer than or equal to the set air-conditioning time.

6. The air-conditioning apparatus of claim 1, wherein the heat medium detection unit is a flowmeter configured to detect presence or absence of a flow of the heat medium and a flow rate of the heat medium, and the controller counts the pump operation time based on the presence or absence of the flow of the heat medium detected by the flowmeter.

7. The air-conditioning apparatus of claim 1, wherein the heat medium detection unit is the pump configured to detect presence or absence of a flow of the heat medium based on a rotation speed, and the controller counts the pump operation time based on the rotation speed of the pump.

8. The air-conditioning apparatus of claim 1, wherein the heat medium detection unit is an input-output differential pressure switch configured to detect pressures before and after the heat medium flows in the heat medium pipe, and the controller counts the pump operation time based on the detection results of the input-output differential pressure switch.

* * * * *